US005340679A

United States Patent [19]

Badesha et al.

[11] Patent Number: 5,340,679

[45] **Date of Patent: * Aug. 23, 1994**

[54] INTERMEDIATE TRANSFER ELEMENT COATINGS

[75] Inventors: Santokh S. Badesha, Pittsford; Joseph Mammino, Penfield; Dennis A. Abramsohn, Pittsford; Donald S. Sypula, Penfield; Arnold W. Henry, Pittford; George J. Heeks; David H. Pan, both of Rochester; Louis D. Fratangelo, Fairport, all of N.Y.

[73] Assignee: Xerox Corporation, Stamford, Conn.

[ * ] Notice: The portion of the term of this patent subsequent to Aug. 25, 2009 has been disclaimed.

[21] Appl. No.: 35,023

[22] Filed: Mar. 22, 1993

[51] Int. Cl.[5] ..... G03G 13/20

[52] U.S. Cl. ..... 430/126; 430/124; 355/271; 355/277

[58] Field of Search ..... 430/126, 124; 355/271, 355/277

[56] References Cited

U.S. PATENT DOCUMENTS

| | | | |
|---|---|---|---|
| 3,957,367 | 5/1976 | Goel | 355/4 |
| 4,257,699 | 3/1981 | Lentz | 355/3 FU |
| 4,275,134 | 6/1981 | Knechtel | 430/44 |
| 4,341,455 | 7/1982 | Fedder | 355/3 TR |
| 4,853,737 | 8/1989 | Hartley et al. | 430/124 |
| 5,017,432 | 5/1991 | Eddy et al. | 428/422 |
| 5,061,965 | 10/1991 | Ferguson et al. | 355/284 |
| 5,141,788 | 10/1992 | Badesha et al. | 428/36.8 |
| 5,243,392 | 9/1993 | Berkes et al. | 430/126 |

*Primary Examiner*—McCamish Marion E.
*Assistant Examiner*—Mark A. Chapman
*Attorney, Agent, or Firm*—E. O. Palazzo

[57] ABSTRACT

An intermediate toner transfer component comprised of a substrate and thereover a coating comprised of a volume grafted elastomer, which is a substantially uniform integral interpenetrating network of a hybrid composition of a fluoroelastomer and a polyorganosiloxane, said volume graft having been formed by dehydrofluorination of said fluoroelastomer by a nucleophilic dehydrofluorinating agent, followed by addition polymerization by the addition of an alkene or alkyne functionally terminated polyorganosiloxane and a polymerization initiator.

21 Claims, No Drawings

INTERMEDIATE TRANSFER ELEMENT COATINGS

BACKGROUND OF THE INVENTION

The present invention is directed to an imaging apparatus and intermediate toner transfer components thereof. More specifically, the present invention is directed to an imaging apparatus and process wherein an electrostatic latent image is formed on an imaging member and developed with a toner, followed by transfer of the developed image to a coated intermediate transfer belt or component and subsequent transfer with very high transfer efficiency of the developed image from the intermediate transfer element to a permanent substrate, and wherein the intermediate transfer component can possess a charge relaxation time of no more than about $2\times10^2$ seconds in embodiments. The coated intermediate transfer components, such as belts, can be selected for both dry and liquid development systems. Dry and liquid developers can have a number of adverse effects on toner transport belts including degradation of the belts especially with liquid developers. These and other disadvantages are avoided or minimized with the coated intermediate toner transfer systems of the present invention. In embodiments, the coating selected is considered a volume graft polymer, and more specifically, a volume grafted elastomer which is a substantially uniform integral interpenetrating network of a hybrid composition of a fluoroelastomer and a polyorganosiloxane, said volume graft having been formed by dehydrofluorination of said fluoroelastomer by a nucleophilic dehydrofluorinating agent, followed by addition polymerization by the addition of an alkene or alkyne functionally terminated polyorganosiloxane and a polymerization initiator. Further, in embodiments the coating can contain additives, such as reinforcement components like particulates, threads, fillers, cords, fibers, and the like, to enable improvements in the mechanical properties, including tensile characteristics, flexibility properties, and creep of the resulting intermediate toner transfer belts. Processes for effecting reinforcement of a polymer is, for example, to add particulate fillers by the mixing thereof with the polymer. Examples of fillers that can be selected include the fillers of metals and metal oxides, such calcium hydroxide, iron oxide, silicon dioxide, alumina, titanium dioxide, iron, tin, zirconium, zinc, carbon black, especially conductive carbon blacks available from Columbian Chemicals, and the like. The aforementioned mechanical properties can be determined by a number of known techniques such as by utilizing an Instron Model number 1123 in accordance with ASTM standards. Tensile can be determined in accordance with ASTM procedure designation D412, and flexibility is accomplished by bending the polymer film in accordance with ASTM procedure designation D3901. Creep is determined usually in a compression, or shear apparatus by mechanical oscillograph and in accordance with ASTM procedure designation D945.

The formation and development of images on the surface of photoconductive materials by electrostatic means is well known. The electrophotographic imaging process, as taught by C. F. Carlson in U.S. Pat. No. 2,297,691, entails placing a uniform electrostatic charge on a photoconductive insulating layer, such as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. The toner will normally be attracted to those areas of the photoreceptor which retain a charge, thereby forming a toner image corresponding to the electrostatic latent image. This developed image may then be transferred to a substrate such as paper. The transferred image may subsequently be permanently affixed to the substrate by heat, pressure, a combination of heat and pressure, or other suitable fixing means such as solvent or overcoating treatment.

Other methods for forming latent images are also known, such as ionographic methods. In ionographic imaging processes, a latent image is formed on a dielectric image receptor or electroreceptor by ion deposition, as described, for example, in U.S. Pat. Nos. 3,564,556, 3,611,419, 4,240,084, 4,569,584, 2,919,171, 4,524,371, 4,619,515, 4,463,363, 4,254,424, 4,538,163, 4,409,604, 4,408,214, 4,365,549, 4,267,556, 4,160,257, 4,155,093, the disclosures of each of which are totally incorporated herein by reference. Generally, the process entalls application of charge in an image pattern with an ionographic writing head to a dielectric receiver that retains the charged image. The image is subsequently developed with a developer capable of developing charge images.

Numerous methods are known for applying the electroscopic particles to the electrostatic latent image to be developed. One development method, disclosed in U.S. Pat. No. 2,618,552, is known as cascade development. Another technique for developing electrostatic images is the magnetic brush process disclosed in U.S. Pat. No. 2,874,063. This method entalls the carrying of a developer material containing toner and magnetic carrier particles by a magnet. The magnetic field of the magnet causes alignment of the magnetic carriers in a brush-like configuration, and this "magnetic brush" is brought into contact with the electrostatic image bearing surface of the photoreceptor. The toner particles are drawn from the brush to the electrostatic image by electrostatic attraction to the undischarged areas of the photoreceptor, and development of the image results. Other techniques, such as touchdown development, powder cloud development, and jumping development are known to be suitable for developing electrostatic latent images.

Imaging processes wherein a developed image is first transferred to an intermediate transfer means and subsequently transferred from the intermediate transfer means to a substrate are known. For example, U.S. Pat. No. 3,862,848 (Marley), the disclosure of which is totally incorporated herein by reference, discloses an electrostatic method for the reproduction of printed matter in which an electrostatic latent image is developed by the attraction of electroscopic marking particles thereto and is then transferred to a first receptor surface by the simultaneous application of contact and a directional electrostatic field of a polarity to urge the marking particles to the receptor surface, with the image then being transferred from the first receptor surface to a second receptor surface by the simultaneous application of contact and a directional electrostatic field of opposite polarity to urge the marking particles to the second receptor surface.

In addition, U.S. Pat. No. 3,957,367 (Goel), the disclosure of which is totally incorporated herein by reference, discloses a color electrostatographic printing machine in which successive single color powder images are transferred, in superimposed registration with one another, to an intermediary. The multilayered powder image is fused on the intermediary and transferred therefrom to a sheet of support material, forming a copy of the original document.

Further, U.S. Pat. No. 4,341,455 (Fedder), the disclosure of which is totally incorporated herein by reference, discloses an apparatus for transferring magnetic and conducting toner from a dielectric surface to plain paper by interposing a dielectric belt mechanism between the dielectric surface of an imaging drum and a plain paper substrate such that the toner is first transferred to the dielectric belt and subsequently transferred to a plain paper in a fusing station. The dielectric belt is preferably a material, such as TEFLON® or polyethylene, to which toner particles will not stick as they are fused in the heat-fuser station.

Additionally, U.S. Pat. No. 3,537,786 (Schlein et al.), the disclosure of which is totally incorporated herein by reference, discloses a copying machine using a material capable of being persistently internally polarized as the latent image storage means. A removable insulative carrier is applied to the storage means and receives a toner which clings to the carrier in correspondence with a previously applied image pattern. The carrier is then removed from contact with the storage means and forms a record of the recorded image. In one embodiment, the insulative carrier is then passed over a heater to fix the toner so that the insulative carrier forms the final image bearing means. In an alternative embodiment, the insulative carrier bearing the toner is brought into contact with a separate image bearing medium so as to transfer the toner to this image bearing medium which then acts as the final image bearing means. The insulative carrier can be of a material, such as polyethylene, polypropylene, polyethylene glycol terephthalate (MYLAR®), polyterafluoroethylene (TEFLON®), polyvinylidene-acrylonitrile copolymers (SARAN®), cellulose nitrate, cellulose acetate, acrylonitrile-butadiene-styrene terpolymers, cyclicized rubbers, and similar irradiation transparent, essentially non-photopolarizable organic or inorganic materials having a volume resistivity greater than $10^9$ ohm-cm.

U.S. Pat. No. 3,893,761 (Buchan et al.), the disclosure of which is totally incorporated herein by reference, discloses an apparatus for transferring nonfused xerographic toner images from a first support material, such as a photoconductive insulating surface, to a second support material, such as paper, and fusing the toner images to the second support material. Such apparatus includes an intermediate transfer member having a smooth surface of low surface free energy below 40 dynes per centimeter and a hardness of from 3 to 70 durometers. The intermediate transfer member can be, for example, a 0.1 to 10 mil layer of silicone rubber or a fluoroelastomer coated onto a polyamide support. The member can be formed into belt or drum configuration. Toner images are transferred from the first support material to the intermediate transfer member by any conventional method, preferably pressure transfer. The toner image is then heated on the intermediate transfer member to at least its melting point temperature, with heating preferably being selective. After the toner is heated, the second support material is brought into pressure contact with the hot toner whereby the toner is transferred and fused to the second support material.

In addition, U.S. Pat. No. 4,275,134 (Knechtel), the disclosure of which is totally incorporated herein by reference, discloses an electrophotographic process using a photosensitive medium having an insulating layer on a photoconductive layer, the surface of the photosensitive medium being uniformly charged with a primary charge. The primary charged surface of the photosensitive medium is then charged with a charge of the opposite polarity or discharged, and simultaneously therewith or therebefore or thereafter exposed to image light from an original. A grid image is protected upon the surface of the photosensitive medium. For multicolor representation, the steps can be repeated in accordance with the number of colors desired. In this instance, the color images are transferred onto an intermediate drum which can be, for example, coated with a layer of TEFLON®.

Further, U.S. Pat. No. 4,682,880 (Fujii et al.), the disclosure of which is totally incorporated herein by reference, discloses a process wherein an electrostatic latent image is formed on a rotatable latent image bearing member and is developed with a developer into a visualized image. The visualized image is transferred by pressure to a rotatable visualized image bearing member. The steps are repeated with different color developers to form on the same visualized image bearing member a multicolor image which corresponds to one final image to be recorded. The latent image bearing member and the visualized image bearing member form a nip therebetween through which a recording material is passed so that the multicolor image is transferred all at once to a recording material.

U.S. Pat. No. 2,885,955 (Vyverberg) discloses an apparatus for printing on print-receiving material of a type liable to dimensional change or change in other physical characteristics when subjected to xerographic heat or vapor fixing techniques. The apparatus contains a rotatable xerographic cylinder having an image forming surface with a photoconductive layer and a means for rotating the cylinder through a predetermined path of movement relative to a plurality of xerographic processing stations, including a charging station for applying electric charge to the photoconductive layer, an exposure station with a projection means for projecting a light image onto the charge photoconductive layer to form an electrostatic latent image, and a developing station having a means for depositing powdered developing material on the photoconductive layer to develop the latent image. In addition, the apparatus contains a means for supporting a web of water receptive planographic printing material, a means for moving the web in surface contact with the photoconductive layer through a portion of its path of movement, a transfer means for transferring the developed image from the photoconductive layer to the web surface while the photoconductive layer and the web are in surface contact, a fixing means for fixing the developed image on the web surface, a means for applying an aqueous solution to the surface of the web, a means for applying lithographic ink to the fixed powder image on the web surface, a feeding means for feeding print receiving material into surface contact with the inked surface of the web, and a means for pressing the print-receiving material into intimate surface contact with the inked powder image on the web surface.

Further, U.S. Pat. No. 3,526,191 (Silverberg et al.) discloses a duplicating process wherein magnetic images of copy to be reproduced are created and used to attract magnetically attractable powder to form subsequent reproductions of the original copy. The magnetic images are deposited and fused to a sheet to form a master. The magnetic field extending from the master can be used to either attract magnetic toner directly to the fused image on the master with subsequent transfer to a copy sheet or the field can extend through a copy sheet placed over the master to attract magnetic toner to the copy sheet in the pattern of the master image. The toner images are then fused to the copy sheet. Mirror images can be avoided by transferring the toner images to intermediate surfaces or by producing the master in a reverse reading form.

Additionally, U.S. Pat. No. 3,804,511 (Ralt et al.) and U.S. Pat. No. 3,993,484 (Ralt et al.) disclose a process wherein an electrostatic image is formed on a surface and magnetic toner particles are then applied to the surface and adhere thereto in correspondence with the electrostatic image. Portions of the same surface or another surface are magnetized, as determined by the location of the toner particles, to form a magnetic image corresponding to the electrostatic image. The toner particles are then transferred by friction to a copy medium such as paper while the magnetic image is retained or stored on the surface. Toner particles can then again be applied to the magnetic image for production of additional copies.

"Color Xerography With Intermediate Transfer", J. R. Davidson, Xerox Disclosure Journal, volume 1, number 7, page 29 (July 1976), the disclosure of which is totally incorporated herein by reference, discloses a xerographic development apparatus for providing color images. Registration of the component colors can be improved by the use of a dimensionally stable intermediate transfer member. Component colors such as cyan, yellow, magenta, and black are synchronously developed onto xerographic drums and transferred in registration onto the dimensionally stable intermediate transfer member. The composite color image is then transferred to a receiving surface such as paper. The intermediate transfer member is held in registration at the transfer station for transferring images from the xerographic drums to the member by a hole-and-sprocket arrangement, wherein sprockets on the edges of the drums engage holes in the edge of the intermediate transfer member.

Intermediate transfer elements employed in imaging apparatuses in which a developed image is first transferred from the imaging member to the intermediate and then transferred from the intermediate to a substrate should exhibit both acceptable transfer of the developer material from the imaging member to the intermediate and acceptable to excellent transfer of the developer material from the intermediate to the substrate. Acceptable to excellent transfer occurs when most or all of the developer material comprising the image is transferred and little residual developer remains on the surface from which the image was transferred. Acceptable transfer is particularly important when the imaging process entails generating full color images by sequentially generating and developing images in each primary color in succession and superimposing the primary color images onto each other on the substrate, since undesirable shifting and variation in the final colors obtained can occur when the primary color images are not efficiently transferred to the substrate.

Disclosed in patent application U.S. Ser. No. 513,408, (D/89420), now abandoned, is an imaging apparatus which comprises an imaging member, a means for generating an electrostatic latent image on the imaging member, a means for developing the latent image, an intermediate transfer element having a charge relaxation time of no more than about $2\times10^2$ seconds to which the developed image can be transferred from the imaging member, and a means for transferring the developed image from the intermediate transfer element to a substrate. The disclosure of this application is totally incorporated herein by reference.

Although known processes and materials are suitable for their intended purposes, a need remains for imaging apparatuses and processes employing intermediate coated transfer elements with high transfer efficiencies to and from intermediates, which can be in the form of a belt. In addition, there is a need for imaging apparatuses and processes employing coated intermediate transfer elements that enable generation of full color images with high color fidelity. Further, a need exists for imaging apparatuses and processes employing coated intermediate transfer elements that can be selected for both liquid and dry toner development systems. There is also a need for imaging apparatuses and processes employing intermediate transfer elements that enable simplified and improved registration of superimposed images of different colors on a single substrate sheet to form multicolor or blended color images. Furthermore, there is a need for imaging apparatuses which possess acceptable thermal stability, excellent chemical stability, and also have physical and mechanical stability. There is also a need for imaging apparatuses wherein there are selected low energy surface transfer belts and which belts may be utilized in dry or liquid xerographic imaging and printing systems and processes. Chemical stability as mentioned herein refers, for example, to resistance attack from dry and liquid toners and developers, view of the contact of the transfer element with liquid, charge additive, charge directors, toner resins, and pigments. There is also a need for intermediate transfer components which have excellent transfix characteristics and excellent heat transfer characteristics.

SUMMARY OF THE INVENTION

It is an object of the present invention to provide coated intermediate transfer elements with many of the advantages illustrated herein including high transfer efficiencies.

It is another object of the present invention to provide imaging apparatuses and processes employing coated intermediate transfer elements that enable generation of full color images with high color fidelity.

It Is yet another object of the present invention to provide imaging apparatuses and processes employing certain volume grafted coated intermediate toner transfer elements, such as transfer belts.

It is still another object of the present invention to provide imaging processes employing coated intermediate transfer elements that enable high speed printing processes for the generation of images of more than one color.

Another object of the present invention is to provide imaging processes employing coated intermediate transfer elements that enable simplified and improved registration of superimposed images of different colors on a single substrate sheet to form multicolor or blended color images.

These and other objects of the present invention are accomplished by providing coated intermediate transfer elements, such as toner transfer belts, and imaging processes thereof. The imaging processes can comprise a means for generating an electrostatic latent image on the imaging member, a means for developing the latent image, a coated intermediate transfer element or belt having a charge relaxation time of no more than about $2\times10^2$ seconds to which the developed image can be transferred from the imaging member, and a means for transferring the developed image from the intermediate transfer element to a substrate.

In embodiments, the present invention is directed to an intermediate toner transfer component comprised of a substrate and thereover a coating comprised of a volume grafted elastomer, which is a substantially uniform integral interpenetrating network of a hybrid composition of a fluoroelastomer and a polyorganosiloxane, said volume graft having been formed by dehydrofluorination of said fluoroelastomer by a nucleophilic dehydrofluorinating agent, followed by addition polymerization by the addition of an alkene or alkyne functionally terminated polyorganosiloxane and a polymerization initiator; and an intermediate toner transfer component comprised of a substrate and thereover a coating comprised of a volume grafted elastomer which is a substantially uniform integral interpenetrating network of a hybrid composition of a fluoroelastomer and a polyorganosiloxane.

The process of the present invention can employ any means for generating and developing the latent electrostatic image. For example, electrophotographic processes can be employed, wherein an image is formed on an imaging member by exposure of a photosensitive imaging member to light in an imagewise pattern. In addition, the image can be generated by ionographic processes, wherein the image is formed on a dielectric imaging member by applying a charge pattern to the imaging member in imagewise fashion.

Any suitable developing processes and materials can be employed with the present invention. For example, dry development processes can be employed, either single component development processes in which the developer material is comprised of toner particles, or two component development processes, wherein the developer material comprises toner particles and carrier particles. Typical toner particles can be of any composition suitable for development of electrostatic latent images, such as those comprising a resin and a colorant. Typical toner resins include polyesters, polyamides, polystyrenes, styrene acrylates, styrene butadienes, styrene methacrylates, epoxies, polyurethanes, diolefins, vinyl resins and polymeric esterification products of a dicarboxylic acid, and a diol comprising a diphenol. Examples of vinyl monomers include styrene, p-chlorostyrene, vinyl naphthalene, unsaturated monoolefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl ethers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes; mixtures of these monomers; and the like. The resins are generally present in an amount of from about 30 to about 99 percent by weight of the toner composition, although they can be present in greater or lesser amounts, provided that the objectives of the invention are achieved.

Any suitable pigments or dyes, or mixtures thereof can be employed in the toner particles. Typical pigments or dyes include carbon black, like REGAL 330®, nigrosine dye, aniline blue, magnetites, and mixtures thereof, with carbon black being a preferred colorant. The pigment is preferably present in an amount sufficient to render the toner composition highly colored to permit the formation of a clearly visible image on a recording member. Generally, the pigment particles are present in amounts of from about 1 percent by weight to about 20 percent by weight based on the total weight of the toner composition; however, lesser or greater amounts of pigment particles may be present.

Other colored toner pigments include red, green, blue, brown, magenta, cyan, and yellow particles, as well as mixtures thereof. Illustrative examples of suitable magenta pigments include 2,9-dimethyl-substituted quinacridone and anthraquinone dye, identified in the Color Index as CI 60710, CI Dispersed Red 15, a diazo dye identified in the Color Index as CI 26050, CI Solvent Red 19, and the like. Illustrative examples of suitable cyan pigments include copper tetra-4-(octadecyl sulfonamide) phthalocyanine, X-copper phthalocyanine pigment, listed in the Color Index as CI 74160, CI Pigment Blue, and Anthradanthrene Blue, identified in the Color index as CI 69810, Special Blue X-2137, and the like. Illustrative examples of yellow pigments that can be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dlmethoxy acetoacetanilide, Permanent Yellow FGL, and the like. These color pigments are generally present in an amount of from about 5 weight percent to about 20.5 weight percent based on the weight of the toner resin particles, although lesser or greater amounts may be present.

When the pigment particles are magnetites, which comprise a mixture of iron oxides ($Fe_3O_4$), such as those commercially available as MAPICO BLACK™, these pigments are present in the toner composition in an amount of from about 10 percent by weight to about 70 percent by weight, and preferably in an amount of from about 20 percent by weight to about 50 percent by weight, although they can be present in greater or lesser amounts, provided that the objectives of the invention are achieved.

The toner can contain charge additives, toner resins, and other additives as illustrated in U.S. Pat. Nos. 4,264,697; 4,298,672; 4,338,390; 4,904,762; 4,937,157; 4,833,736; 4,845,003, the disclosures of which are totally incorporated herein by reference; distearyl dimethyl ammonium methyl sulfate, and those as illustrated in copending application U.S. Ser. No. 755,919 (D/90404), the disclosure of which is totally incorporated herein by reference, and the like. The toner compositions can be prepared by any suitable method. For example, a method known as spray drying entails dissolving the appropriate polymer or resin in an organic solvent, such as toluene or chloroform, or a suitable solvent mixture. The toner colorant is also added to the solvent. Vigorous agitation, such as that obtained by ball milling processes, assists in assuring good dispersion of the colorant. The solution is then pumped through an atomizing nozzle while using an inert gas, such as nitrogen, as the atomizing agent. The solvent evaporates during atomization, resulting in toner particles of a pigmented resin, which are then attrited and classified by particle size. Particle volume average diameter of the resulting toner varies, depending on the size of the nozzle, and generally varies between about 0.1 and about 100 and preferably from about 5 to about 20 microns.

Another suitable toner process is known as the Banbury method, a batch process wherein the dry toner ingredients are preblended and added to a Banbury mixer and mixed, at which point melting of the materials occurs from the heat energy generated by the mixing process. The mixture is then dropped into heated rollers and forced through a nip, which results in further shear mixing to form a large thin sheet of the toner material. This material is then reduced to pellet form and further reduced in size by grinding or jetting, after which the particles are classified by size. A third suitable toner preparation process, extrusion, is a continuous process that entalls dry blending the toner ingredients, placing them into an extruder, melting and mixing the mixture, extruding the material, and reducing the extruded material to pellet form. The pellets are further reduced in size by grinding or jetting, and are then classified by particle size. Dry toner particles for two-component developers generally have an average particle size between about 6 microns and about 20 microns. Other similar toner blending methods may also be used. Subsequent to size classification of the toner particles, external additives may be blended with the toner particles. The resulting toner composition is then mixed with carrier particles such that the toner is present in an amount of about 1 to about 5 percent by weight of the carrier, and preferably about 3 percent by weight of the carrier, although different toner to carrier ratios are acceptable, provided that the objectives of the present invention are achieved.

Any suitable external additives can also be utilized with the dry toner particles. The amounts of external additives are measured in terms of percentage by weight of the toner composition, but are not themselves included when calculating the percentage composition of the toner. For example, a toner composition containing a resin, a pigment, and an external additive can comprise 80 percent by weight of resin and 20 percent by weight of pigment; the amount of external additive present is reported in terms of its percent by weight of the combined resin and pigment. External additives can include any additives suitable for use in electrostatographic toners, including silica, colloidal silica like AEROSIL R972®, available from Degussa, Inc., ferric oxide, UNILIN®, polypropylene waxes, polymethylmethacrylate, zinc stearate, chromium oxide, aluminum oxide, stearic acid, polyvinylidene fluoride like KYNAR®, available from Pennwalt Chemicals Corporation, and the like. External additives can be present in any suitable amount such as from about 0.05 to about 5 weight percent.

Any suitable carrier particles can be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles can vary, but are generally from about 50 microns to about 1,000 microns, thus allowing the particles to possess sufficient density and inertia to avoid adherence to the electrostatic images during the development process. Carrier particles can possess coated surfaces. Typical coating materials include polymers and terpolymers, including, for example, fluoropolymers such as polyvinylidene fluorides as disclosed in U.S. Pat. Nos. 3,526,533, 3,849,186, and 3,942,979, the disclosures of each of which are totally incorporated herein by reference. The toner may be present, for example, in the two-component developer in an amount equal to about 1 to about 5 percent by weight of the carrier, and preferably is equal to about 3 percent by weight of the carrier.

Typical dry toners are also disclosed in, for example, U.S. Pat. Nos. 2,788,288, 3,079,342, and U.S. Pat. No. Re. 25,136, the disclosures of each of which are totally incorporated herein by reference.

In addition, development can be effected with liquid developers. Liquid developers are disclosed, for example, in U.S. Pat. Nos. 2,890,174 and 2,899,335, and copending patent applications U.S. Ser. No. 986,316 (D/91310), U.S. Ser. No. 013,132 (D/90095C), U.S. Ser. No. 009,202 (D/92570) and U.S. Ser. No. 009,192 (D/92571), the disclosures of each of which are totally incorporated herein by reference.

Any suitable conventional electrophotographic development technique can be utilized to deposit toner particles on the electrostatic latent image on the imaging member. Well known electrophotographic development techniques include magnetic brush development, cascade development, powder cloud development, electrophoretic development, and the like. Magnetic brush development is more fully described in, for example, U.S. Pat. No. 2,791,949, the disclosure of which is totally incorporated herein by reference; cascade development is more fully described in, for example, U.S. Pat. Nos. 2,618,551 and 2,618,552, the disclosures of each of which are totally incorporated herein by reference; powder cloud development is more fully described in, for example, U.S. Pat. Nos. 2,725,305, 2,918,910, and 3,015,305, the disclosures of each of which are totally incorporated herein by reference; and liquid development is more fully described in, for example, U.S. Pat. No. 3,084,043, the disclosure of which is totally incorporated herein by reference.

The transfer element employed for the present invention can be of any suitable configuration. Examples of suitable configurations include a sheet, a web, a foil, a strip, a coil, a cylinder, a drum, an endless belt, an endless mobius strip, a circular disc, or the like. Typically, the transfer element has a thickness of from about 2 to about 10 mils.

The coated toner transfer elements, or belts of the present invention in embodiments can have a charge relaxation time of no more than about $2\times10^2$ seconds to ensure efficient transfer from the intermediate to the substrate. The lower limit of suitable charge relaxation times is theoretically unlimited, and conductive materials, such as metals, can be employed as the transfer element. While not being limited by any theory, however, it is believed that the lower limit on the charge relaxation time for an intermediate transfer element in any given situation will be determined by the conductivity of the receiving substrate to which the toner image is ultimately transferred. Specifically, no shorting should occur between the intermediate transfer element and the substrate around the toner piles constituting the image, since shorting would result in little or no transfer field to effect transfer from the intermediate to the substrate. Typically, for transfer to paper, the charge relaxation time is from about $1\times10^{-3}$ seconds to about $2\times10^{2}$ seconds. The charge relaxation time (1). of a material is generally a function of the dielectric constant (K), the volume resistivity ($\rho$) of that material, and the permittivity of free space ($\kappa_0$, a constant equal to $8.854\times10^{-14}$ farads per centimeter), wherein $\tau=K\epsilon_0\rho$.

Examples of problems to be addressed with respect to intermediate transfer mediums, such as belts and rolls, include the proper selection of the base metal, polymer, or mixtures thereof, material, and with respect to the present invention in embodiments a specific overcoating is selected. Also, in embodiments an interface material, such as an adhesive, is selected.

Examples of materials that can be coated and having suitable charge relaxation times include polyvinyl fluoride, such as TEDLAR ®, available from E.I. DuPont de Nemours & Company, polyvinyl fluoride loaded with conductive or dielectric fillers such as carbon particles, titanium dioxide, barium titanate, or any other filler capable of decreasing dielectric thickness, polyvinylidene fluoride, such as KYNAR ®, available from Pennwalt Corporation, polyvinylidene fluoride loaded with conductive or dielectric fillers such as carbon particles, titanium dioxide, barium titanate, or any other filler capable of decreasing dielectric thickness, certain papers, such as Xerox Corporation 4024 paper or Xerox Corporation Series 10 paper, and the like. In addition, metals that can be coated include aluminum, copper, brass, nickel, zinc, chromium, stainless steel, semitransparent aluminum, steel, cadmium, silver, gold, indium, tin, and the like. Metal oxides, including tin oxide, indium tin oxide, and the like, are also suitable. Any other material having the desired charge relaxation characteristics can also be employed. Fillers employed to alter the relaxation time of a material may be present in any amount necessary to effect the desired relaxation time; typically, fillers are present in amounts of from 0 to about 80 percent by weight. When paper or other materials for which conductivity is affected by relative humidity is used as the intermediate, the relative humidity may have to be controlled during the imaging process to maintain the intermediate transfer element at the desired charge relaxation time. In general, intermediate transfer elements of materials for which the charge relaxation time changes significantly with relative humidity perform optimally at relative humidities of 60 percent or less.

The coatings selected, which can be applied by known methods such as spray coating, dip coating, flow coating, and the like, for the intermediate transfer belts are comprised of a volume grafted elastomer which is a substantially uniform integral interpenetrating network of a hybrid composition of a fluoroelastomer and a polyorganosiloxane, said volume graft having been formed by dehydrofluorination of said fluoroelastomer by a nucleophilic dehydrofluorinating agent, followed by addition polymerization by the addition of an alkene or alkyne functionally terminated polyorganosiloxane and a polymerization initiator. The fluoroelastomer is in embodiments selected from the group consisting of poly(vinylidene fluoride-hexafluoropropylene) and poly(vinylidenehexafluoropropylene-tetrafluoroethylene), and the polyorganosiloxane in embodiments is of the formula:

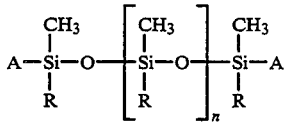

where R is an alkyl, alkenyl or aryl having, for example, less than 19 carbon atoms or an aryl group substituted with an amino, hydroxy, mercapto or alkyl or alkenyl group having less than 19 carbon atoms. The functional group A, is an alkene or alkyne with, for example, 1 to 10 carbon atoms, or an alkene or alkyne substituted with an alkyl or aryl having less than 19 carbon atoms, and n is 2 to 350. Alkyl, alkenyl and aryl examples are known and include methyl, ethyl, ethylene, propyl, propylene, butyl, butylene, pentyl, pentylene, phenyl, naphthyl, halobenzyl, and the like.

Examples of specific overcoating materials for the intermediate transfer elements include fluoroelastomers, such as copolymers of vinylidene fluoride and hexafluoropropylene; terpolymers of vinylidene fluoride, hexafluoropropylene, and tetrafluoroethylene; VITON E-45 TM, VITON GF TM, TEFLON ®, all available from E.I. DuPont; ALFAS TM available from E.I. DuPont; FLUOREL I TM and II TM, available from 3M; TECNOFLON TM, and the like.

It is believed that some of the aforementioned and others that can be selected have the following formulas

VITON E-45 TM

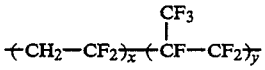

VITON GF TM

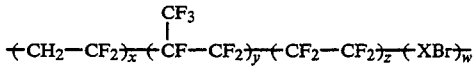

ALFAS TM

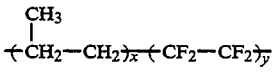

FLUOREL I TM

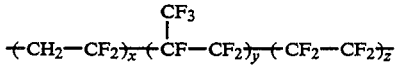

FLUOREL II TM

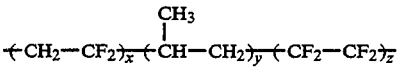

TECNOFLON TM

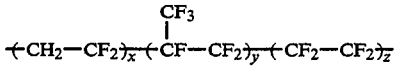

the subscripts, such as x, y, and z, represent the number of repeating segments.

By volume graft, it is intended to refer in embodiments to a substantially uniform integral interpenetrating network of a hybrid composition, wherein both the structure and the composition of the fluoroelastomer and polyorganosiloxane are substantially uniform when taken through different slices of the fuser member. Interpenetrating network is intended to refer to the addition polymerization matrix where the fluoroelastomer and polyorganosiloxane polymer strands are intertwined in one another. Hybrid composition is intended to define a volume grafted composition which is comprised of fluoroelastomer and polyorganosiloxane blocks randomly arranged.

Examples of volume graft coating materials are comprised of VITON TM and a polysiloxane with optional fillers, reference U.S. Pat. No. 5,141,788 (D/89394D), the disclosure of which is totally incorporated herein by reference.

The dehydrofluorinating agent can be selected from the group consisting of primary, secondary and tertiary aliphatic and aromatic amines where the aliphatic and aromatic groups have from 2 to 15 carbon atoms, and aliphatic and aromatic diamines and triamines having from 2 to 15 carbon atoms, and more specifically, the dehydrofluorinating agent is a primary aliphatic amine such as an alkyl amine having up to 19 carbon atoms. The polymerization initiator can be selected from the group consisting of aliphatic and aromatic peroxides with benzoyl peroxide azolsobutyronitrile being preferred.

The developed image on the coated intermediate transfer element is subsequently transferred to a substrate. Preferably, prior to transfer the developed image on the intermediate is charged by, for example, exposure to a corotron to ensure that all of the toner particles are charged to the same polarity, thereby enhancing transfer efficiency by eliminating any wrong-sign toner. Wrong-sign toner is toner particles that have become charged to a polarity opposite to that of the majority of the toner particles and the same as the polarity of the latent image. Wrong-sign toner particles typically are difficult to transfer to a substrate. Examples of substrates include paper, transparency material such as polyester, polycarbonate, or the like, cloth, wood, or any other desired material upon which the finished image will be situated. If desired, the transferred developed image can thereafter be fused to the substrate by conventional means. Typical, well known electrophotographic fusing techniques include heated roll fusing, flash fusing, oven fusing, laminating, vapor fusing, adhesive spray fixing, and the like.

Transfer of the developed image from the imaging member to the intermediate transfer element and transfer of the image from the intermediate transfer element to the substrate can be by any suitable technique conventionally used in electrophotography, such as corona transfer, pressure transfer, bias roll transfer, and combinations of those transfer means, and the like. In the situation of transfer from the intermediate transfer medium to the substrate, transfer methods such as adhesive transfer, wherein the receiving substrate has adhesive characteristics with respect to the developer material, can also be employed. Typical corona transfer entails contacting the deposited toner particles with the substrate and applying an electrostatic charge on the surface of the substrate opposite to the toner particles. A single wire corotron having applied thereto a potential of between about 5,000 and about 8,000 volts provides satisfactory transfer. In a specific process, a corona generating device sprays the back side of the image receiving member with ions to charge it to the proper potential so that it is tacked to the member from which the image is to be transferred and the toner powder image is attracted from the image bearing member to the image receiving member. After transfer, a corona generator charges the receiving member to an opposite polarity to detack the receiving member from the member that originally bore the developed image, whereupon the image receiving member is separated from the member that originally bore the image.

Bias roll transfer is another method of effecting transfer of a developed image from one member to another. In this process, a biased transfer roller or belt rolls along the surface of the receiving member opposite to the surface that is to receive the developed image. Further data concerning bias roll transfer methods is provided in, for example, U.S. Pat. No. 2,807,233, 3,043,684, 3,267,840, 3,328,193, 3,598,580, 3,625,146, 3,630,591, 3,684,364, 3,691,993, 3,702,482, 3,781,105, 3,832,055, 3,847,478, 3,942,888, and 3,924,943, the disclosures of each of which are totally incorporated herein by reference.

The volume grafting can be accomplished in two steps, the first involves the dehydrofluorination of the fluoroelastomer preferably using an amine. During this step, hydrofluoric acid is eliminated which generates unsaturation, carbon to carbon double bonds, on the fluoroelastomer. The second step is the free radical peroxide induced addition polymerization of the alkene or alkyne terminated polyorganosiloxane with the carbon to carbon double bonds of the fluoroelastomer.

Examples of fluoroelastomers are those described in U.S. Pat. No. 4,257,699 to Lentz, as well as those described in commonly assigned U.S. Pat. No. 5,017,432 (D/87188C) and U.S. Pat. No. 5,061,965 (D/89516), the disclosures of which are totally incorporated herein by reference. These fluoroelastomers, particularly from the class of copolymers and terpolymers of vinylidene fluoride hexafluoropropylene and tetrafluoroethylene, are known commercially under various designations as VITON A TM, VITON E, TM VITON E60C TM, VITON E430 TM, VITON 910 TM, VITON GH TM and VITON GF TM. The Viton designation is a Trademark of E.I. DuPont de Nemours, Inc. Other commercially available materials include FLUOREL2170 TM, FLUOREL2174 TM, FLUOREL2176 TM, FLUOREL2177 TM and FLUOREL LVS76 TM, FLUOREL TM being a Trademark of 3M Company. Additional commercially available materials include AFLAS TM a poly(propylene-tetrafluoroethylene), FLUOREL II TM (LII1900) a poly(propylene-tetrafluoroethylene-vinylidenefluoride), both also available from 3M Company, as well as the TECNOFLONS TM identified as FOR-60KIR TM, FOR-LHF TM, NM TM, FOR-THF TM, FOR-TFS TM, TH TM, TN505 TM available from Montedison Specialty Chemical Company. Typically, these fluoroelastomers are cured with a nucleophilic addition curing system, such as a bisphenol crosslinking agent with an organophosphonium salt accelerator as described in further detail in the U.S. Pat. No. 4,257,699 patent, and in U.S. Pat. No. 5,017,432 (D/87188C), the disclosure of which is totally incorporated herein by reference.

In one preferred embodiment, the fluoroelastomer is one having a relatively low quantity of vinylidene fluoride, such as in VITON GF TM, available from E.I. DuPont de Nemours, Inc. The VITON GF TM has, it is believed, 35 mole percent vinylidene fluoride, 34 percent hexafluoropropylene and 29 mole percent tetrafluoroethylene with 2 percent cure site monomer. It is generally cured with bisphenol phosphonium salt, or a conventional aliphatic peroxide curing agent.

Examples of polyorganosiloxanes with functionality can be represented by the formula as illustrated herein wherein R is an alkyl, alkenyl or aryl having less than about 20 carbon atoms or an aryl group substituted with an amino, hydroxy, mercapto or an alkyl or alkenyl group having less than 19 carbon atoms. The functional group A, is an alkene or alkyne group with about 10 carbon atoms or an alkene or alkyne substituted with an alkyl or aryl group having less than 19 carbon atoms and n is 2 to 350. In the formula, typical R groups include methyl, ethyl, propyl, octyl, vinyl, allyl crotnyl, phenyl, naphthyl and phenanthryl and typical substituted aryl groups are substituted in the ortho, meta and para positions with lower alkyl groups having less than 15 carbon atoms. Furthermore, in a preferred embodiment n is between 60 and 80 to provide a sufficient number of reactive groups to graft onto the fluoroelastomer. Typical alkene and alkenyl functional groups include vinyl, acrylic, crotonic and acetenyl which may typically be substituted with methyl, propyl, butyl, benzyl, and tolyl groups.

The dehydrofluorinating agent, which attacks the fluoroelastomer generating unsaturation, is selected from the group of strong nucleophilic agents such as peroxides, hydrides, bases, oxides, etc. The preferred agents are selected from the group consisting of primary, secondary and tertiary, aliphatic and aromatic amines, where the aliphatic and aromatic groups have from 2 to 15 carbon atoms. It also includes aliphatic and aromatic diamines and triamines having from 2 to 15 carbon atoms where the aromatic groups may be benzene, toluene, naphthalene or anthracene etc. It Is generally preferred for the aromatic diamines and triamines that the aromatic group be substituted in the ortho, meta and para positions. Typical substituents include lower alkylamino groups such as ethylamino, propylamino and butylamino with propylamino being preferred. Specific amine dehydrofluorinating agents include N-(2-aminoethyl-3-aminopropyl)-trimethoxy silane, 3-(N-strylmethyl-2-aminoethylamino) propyltrimethoxy silane hydrochloride and (aminoethylamino methyl) phenethyltrimethoxy silane. The dehydrofluorinating agent generates double bonds by dehydrofluorination of the fluoroelastomer compound so that when the unsaturated functionally terminated polyorganosiloxane is added with the initiator, the free radical polymerization of the siloxane with the unsaturation sites of the fluoroelastomers is initiated. Typical free radical polymerization initiators for this purpose are benzoyl peroxide and azoisobutyronitrile, AIBN.

Other adjuvants and fillers may be incorporated in the elastomer in accordance with the present invention providing they do not adversely affect the integrity of the fluoroelastomer. Such fillers normally encountered in the compounding of elastomers include coloring agents, reinforcing fillers, crosslinking agents, processing aids, accelerators and polymerization initiators. Following coating of the fluoroelastomer on the substrate, it is subjected to a step curing process at about 38° C. for 2 hours followed by 4 hours at 77° C., 2 hours at 93° C., 2 hours at 149° C., 2 hours at 177° C. and 16 hours at 208° C.

The volume graft overcoating illustrated herein can be coated on the supporting or base layer, with or without an adhesive layer therebetween, reference U.S. Ser. No. 961,969 (D/92077), the disclosure of which is totally incorporated herein by reference. The thickness of the layer which can be comprised of suitable polymers, such as acrylic, epoxy, silane and the like, can range to from about 0.2 to about 1 mil and preferably from about 0.25 mils to about 5 mils.

The coating for the intermediate belt can be prepared by dissolving the fluoroelastomer in a typical solvent, such as methyl ethyl ketone, methyl isobutyl ketone and the like, followed by stirring for 15 to 60 minutes at 45° to 85° C. after which the polymerization initiator, which is generally dissolved in an aromatic solvent, such as toluene, is added with continued stirring for 5 to 25 minutes. Subsequently, the polyorganosiloxane is added with stirring for 30 minutes to 10 hours at a temperature of 45° to 85° C. After cooling to room temperature, about 25° C., a nucleophilic curing agent, such as VITON CURATIVE VC50 TM (bisphenol A based curing agent obtained from E.I. DuPont), which incorporates an accelerator, (a quaternary phosphonium salt or salts) and a crosslinking agent, bisphenol AF, in a single curative system is added in a 3 to 7 percent solution predissolved in the fluoroelastomer compound. Optimally, the basic oxides, MgO and $Ca(OH)_2$, are added in particulate form to the solution mixture. Providing the layer on the substrate is most conveniently carried out by spraying, dipping or the like a solution of the homogeneous suspension of the volume graft to a level of film of about 12.5 to about 125 micrometers in thickness. This thickness range is selected as providing a layer thin enough for high transfer efficiency and thick enough to allow a reasonable wear life. While molding, extruding and wrapping techniques are alternative means which may be used, we prefer to spray successive applications of the solvent solution. When the desired thickness of coating is obtained, the coating is cured and thereby bonded to the substrate surface. A typical step curing process is heating for two hours at 93° C., followed by 2 hours at 149° C., followed by 2 hours at 177° C., and followed by 16 hours at 208° C. In an alternative method, the solvent maybe removed by evaporation by known means, the residue rinsed with a hydrocarbon solvent, such as hexane, to remove unwanted reactants, if any, and the residue redissolved in the original solvent followed by the addition of CURATIVE No. 50 TM, and basic oxides such as magnesium oxide, calcium hydroxide, and the like, and the subsequent formation of the layer.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

A stainless steel belt was abraded with sand paper, followed by degreasing, scrubbing with an abrasive cleaner, and thoroughly washing with water. An epoxy primer THIOXON 330/301 was then applied to a thickness of 2 to 3 tenths of a mil (5 to 7.5 micrometers), air dried at ambient conditions for 30 minutes and baked at 150° C. for 30 minutes. Subsequently, the primed belt was provided with a coating of a volume graft elastomer which was prepared by dissolving 250 grams of VITON GF TM In 2.5 liters of methylethyl ketone (MEK) by stirring at room temperature. This was accomplished by using a 4 liter plastic bottle and a moving base shaker for about one hour to two hours to accomplish the dissolution depending upon the speed of the shaker. The above solution is then transferred to a 5 liter Erlenmyer flask and 25 milliliters of the amine dehydrofluorinating agent, 3-(N-strylmethyl-2-aminoethylamino) propyltrimethoxysilane hydrochloride (S-1590, available from Huls America Inc. Piscataway, N.J.) was added. The contents of the flask were then stirred using a mechanical stirrer while maintaining the temperature between 55° and 60° C. After stirring for 30 minutes, 50 milliliters of 100 centistoke vinyl terminated polysiloxane (PS-441) also available from Huls America Inc. was added and stirring was continued for another ten minutes. A solution of 10 grams of benzoyl peroxide in a 100 milliliter mixture of toluene and MEK (80:20) was then added. The stirring was continued while heating the contents of the flask at about 55° C. for another 2 hours. During this time, the color of the solution turned light yellow, the solution was then poured into an open tray. The tray was left in the hood overnight (16 hours). The resulting yellow rubbery mass left after the evaporation of the solvent was then cut into small pieces with a scissor. This material was then extracted extensively and repeatedly with 1,500 milliliters (three 500 milliliter portions) of n-hexane to remove unreacted siloxane.

Thereafter, 54.5 grams of the prepared silicone grafted fluoroelastomer, together with 495 grams of methyl isobutyl ketone, 1.1 grams of magnesium oxide and 0.55 gram of calcium hydroxide $(CaOH)_2$ were added to a jar containing ceramic balls followed by roll milling for (media) 17 to 24 hours until a fine, 3 to 5 microns in diameter particle size of the fillers in dispersion was obtained. Subsequently, 2.5 grams of DuPont CURATIVE VC50 TM catalyst crosslinker in 22.5 parts of methyl ethyl ketone were added to the above dispersion, shaken for about 15 minutes and the solids content reduced to 5 to 7 percent by the addition of methyl isobutyl ketone. Following hand mixing, the mixture was air sprayed on to the above primed belt to a dry thickness of about 4.5 mils (1 12.5 micrometers) and cured in ambient dry air for 24 hours followed by the above-mentioned post step curing procedure, that is heating for 2 hours at 93° C., heating for 2 hours at 149° C., heating for 2 hours at 177° C., and thereafter heating for 16 hours at 208° C., followed by cooling.

EXAMPLE II

The processes of Example I were essentially repeated as follows:

A nickel belt was abraded with sand paper, followed by degreasing, scrubbing with an abrasive cleaner and thoroughly washing with water. An epoxy primer THIOXON 330/301 was applied to a thickness of 2 to 3 tenths of a mil (5 to 7.5 micrometers), air dried at ambient conditions for 30 minutes and baked at 150° C. for 30 minutes. Subsequently, the primed belt was provided with a coating of a volume graft elastomer which was prepared by dissolving 250 grams of VITON GF TM In 2.5 liters of methylethyl ketone (MEK) by stirring at room temperature. This is accomplished by using a 4 liter plastic bottle and a moving base shaker. It takes approximately one hour to two hours to accomplish the dissolution depending upon the speed of the shaker. The above solution is then transferred to a 4 liter Erlenmyer flask and 25 mils of the amine dehydrofluorinating agent, 3-(N-strylmethyl-2-aminoethylamino) propyltrimethoxysilane hydrochloride (S-1 590, available from Huls America Inc., Piscataway, N.J.), was added. The contents of the flask were then stirred using a mechanical stirrer while maintaining the temperature between 55° and 600C. After stirring for 30 minutes, 50 milliliters of 100 centistoke vinyl terminated polysiloxane (PS-441) also available from Huls America Inc. was added and stirring continued for another ten minutes. A solution of 10 grams of benzoyl peroxide in a 100 milliliter mixture of toluene and MEK (80:20) was then added. The stirring was continued while heating the contents of the flask around 55° C. for another 2 hours. During this time the color of the solution turned light yellow.

To 2 liters of the above solution was added 2.2 grams of magnesium oxide and 1.1 grams of calcium hydroxide, and the contents were ball jar milled with media as in Example I for about 17 hours, after which a fine dispersion, 3 to 5 microns in diameter, resulted. To this dispersion was added 5.5 grams of CURATIVE VC50 TM obtained from E.I. DuPont in 50 milliliters of methylethyl ketone was added and the resulting mixture was shaken for 15 minutes. Thereafter, the mixture resulting was sprayed with a Brinks Number 62 hand held gun onto the primed belt to a dry thickness of 4.5 mils, 112 micrometers, and cured in ambient dry air for 24 hours, followed by the above mentioned post curing procedure of Example I.

There resulted a belt comprised of a nickel substrate, 3 mils in thickness, an interface layer 6 microns in thickness, and an overcoating of the cured volume elastomer graft, about 4.5 mils, 112 microns, in thickness.

EXAMPLE Ill

To 2 liters of the solution of Example II were added 2.2 grams of magnesium oxide, 5 grams of carbon black REGAL N-9910 and 1.1 grams of calcium hydroxide, and the contents were ball jar milled with media for about 17 hours, after which a fine, 3 to 5 microns, dispersion resulted. To this dispersion was added 5.5 grams of CURATIVE VC50 TM obtained from E.I. DuPont in 50 milliliters of methylethyl ketone was added and the resulting mixture was shaken for 15 minutes. Thereafter, the mixture resulting was sprayed as in Example I onto a primer THIXON 330/331 TM epoxy coated polyamide sheet with a surface resistivity of about $10^9$ ohm/cm. The polyamide substrate thickness was 75 microns. The polyamide sheet was joined end to end to form an endless belt to a dry thickness of 4.5 mils, 112 micrometers, and cured in ambient dry air for 24 hours, followed by the above-mentioned post curing procedure of Example I.

There resulted a belt with the same components of Example I and with the thicknesses indicated.

The volume graft overcoated belt of Example III was then placed in a laboratory liquid development test fixture, and the belts had excellent transfer efficiencies, as measured by a densitometer RD918 available from Macbeth Inc. of New York, of 96 percent, and these belts had excellent characteristics enabling superior transfer of developed xerographic latent images. There was achieved with each of the belts excellent toner transfer efficiency, as measured with the Macbeth densitometer, of 100 percent both from the photoreceptor to the belts and from the belt to paper. The intermediate transfer member can be employed in an electrophotographic imaging system for electrostatic transfer of a toner image wherein the system comprises at least one image forming device, reference U.S. Ser. No. 957,140 (D/92071), the disclosure of which is totally incorporated herein by reference. Typically, four image forming devices are utilized. The image forming devices may each comprise an image receiving member in the form of a photoreceptor about which are positioned image forming components of the imaging structure. The image forming components further comprise exposure structures, developing structures, transfer structures, cleaning structures and charging structures. Charging structures can comprise conventional corona discharge devices. The intermediate transfer member of the invention, such as an intermediate transfer belt, is supported for movement in an endless path such that incremental portions thereof move past the image forming components for transfer of an image from each of the image receiving members. Each image forming component is positioned adjacent the intermediate transfer member for enabling sequential transfer of different color toner images to the intermediate transfer member in superimposed registration with one another.

Exposure structures employed can be any suitable type employed in the art. Typical exposure structures employed include, but are not limited to, raster input-/output scanning devices (RIS/ROS) or any combination using the RIS/ROS devices. The light source employed can be any suitable light source employed in the art, such as a laser.

The intermediate transfer member is used in a manner that enables each incremental portion thereof to move past an image forming component. A color image component corresponding to a yellow component of an original document to be copied may be formed on the image receiving member (photosensitive drum or photoreceptor) using the charging structure, the exposure structure and the developing structure. The developing structure develops a yellow toner image on the image receiving member. A transfer structure, which can comprise a corona discharge device, serves to effect transfer of the yellow component of the image at the area of contact between the receiving member and the intermediate transfer member.

Also, in a similar manner, magenta, cyan and black image components corresponding to magenta, cyan and black components of the original document also can be formed on the intermediate transfer member one color on top of the other to produce a full color image.

The intermediate transfer member is moved through a transfer station wherein the multicolored image is electrostatically transferred to a transfer sheet or copy sheet. The transfer sheet or copy sheet itself may be electrostatically charged with a corotron device at the transfer station. The transfer sheet or copy sheet is moved into contact with the toner image at the transfer station. The sheet is advanced to the transfer station by any suitable sheet feeding apparatus. For example, feed rollers rotate so as to advance the uppermost sheet from a stack of sheets into contact with the intermediate transfer member in times sequence so that the toner powder image thereon contacts the advancing sheet at the transfer station. At the transfer station, a Biased Transfer Roll (BTR) is used to provide good contact between the sheet and the toner image during transfer. A corona transfer device also can be provided for assisting the BTR in effecting image transfer. These imaging steps can occur simultaneously at different incremental portions of the intermediate transfer member.

Suitable devices in which the intermediate transfer member of the present invention can be employed include, but are not limited to, devices described in U.S. Pat. Nos. 3,893,761; 4,531,825; 4,684,238; 4,690,539; 5,119,140 and 5,099,286, the disclosures of which are totally incorporated herein by reference. The intermediate transfer member of the present invention can dissipate charge between toner image stations. It achieves transfer efficiencies of about 95 percent and has nonstretch characteristics enabling good registration of a toner image.

The above prepared belts were also incorporated into a laboratory dry toner development similar to a Xerox Corporation 5090 test fixture, and there was measured transfer efficiences of 96 percent from the imaging member to each of the belts and from each of the belts to paper. The developed images on the paper were then fixed by conventional heat and pressure means.

EXAMPLE IV 54.5 Grams of polyorganosiloxane grafter fluoroelastomer together with 495 grams of methyl isobutyl ketone and 5 grams of carbon black N991, available from Vanderbilt Corporation, were added to a roll mill with glass beads and roll milled for 24 hours to dissolve the elastomer and disperse the carbon black. 2.5 Grams of CURATIVE VC50 TM catalyst crosslinker in 22.5 grams of MICR were added and the mixture milled an additional 15 minutes. The solids content was reduced to about 7 weight percent of the addition of MIBK. The mixture was spray coated onto a 3 mil thick, 12 inches wide, and 36 inches in length sheet film of polyimide to a dry thickness of about 5 mils, cured in ambient dry air for 24 hours, followed by the above post cure curing step. The surface resistivity of the coating was about $4\times10^8$ ohm/cm, and the bulk resistivity of the coating removed from the substrate was about $7\times10$ inches. The tensile modulus of the coated sheet was about 450,000 psi. The sheet was joined end to end to form an endless intermediate toner transfer belt by using a heat activated adhesive tape. The belt was placed into a liquid developer imaging system, reference U.S. Ser. No. 009,202 (D/92570) and U.S. Ser. No. 009,192 (D/92571), such as the Savin 870, and employed in producing multicolor images. The belt achieved acceptable image transfer efficiencies of about 90 percent and exhibited nonstretch characteristics enabling acceptable registration from the polyorganosiloxane grafted fluoroelastomer surface to paper when the image was pressure transfixed and subsequently fused to the paper, and the belt was resistant for the liquid developer.

COMPARATIVE EXAMPLE

Similar belts as those described in Examples I to IV were prepared wherein the overcoating was comprised of VITON B-50 TM, a material available from E.I. DuPont and believed to be a fluoropolymer comprised of a copolymer of vinylidene fluoride and hexafluoropropylene, and tetrafluoroethylene with a mole ratio of 61:17:22.

A solution of VITON B-50 ® was prepared by dissolving 250 grams of the B-50 in 2.5 liters of methylethyl ketone (MEK) by stirring at room temperature, about 25° C. To 2 liters of this solution, there were added in a reaction vessel 2.2 grams of magnesium oxide, 1.1 grams of calcium hydroxide, 5.5 grams of E.I. DuPont CURATIVE VC50 TM, and 5 grams of carbon black N991 obtained from Vanderbilt Corporation. The contents of the vessel were ball milled with media for 17 hours. The resulting black dispersion was then spray coated onto a stainless steel primed belt as in Examples I to III. This belt, which was comprised of the same components and of the same thicknesses of the belt of Example I, was then incorporated into the liquid imaging apparatus of Example III, and there was measured as indicated In Example I that only 85 percent of the liquid toner transferred from the photoreceptor to the belt and 80 percent from the belt to paper.

Similarly, the above prepared belt was incorporated into the dry development test fixture indicated herein, and the toner transfer efficiency was about 80 percent from the imaging member to the belt, and from the belt to paper.

Other embodiments and modifications of the present invention may occur to those skilled in the art subsequent to a review of the information presented herein; these embodiments and modifications, as well as equivalents thereof, are also included within the scope of this invention.

What is claimed is:

1. An intermediate toner transfer component comprised of a substrate and thereover a coating comprised of a volume grafted elastomer, which is a substantially uniform integral interpenetrating network of a hybrid composition of a fluoroelastomer and a polyorganosiloxane, said volume graft having been formed by dehydrofluorination of said fluoroelastomer by a nucleophilic dehydrofluorinating agent, followed by addition polymerization by the addition of an alkene or alkyne functionally terminated polyorganosiloxane and a polymerization initiator.

2. A toner transfer component in accordance with claim 1 wherein said fluoroelastomer is selected from the group consisting of poly(vinylidene fluoride-hexafluoropropylene) and poly(vinylidene fluoride-hexafluoropropylene-tetrafluoroethylene).

3. A toner transfer component in accordance with claim 1 wherein said polyorganosiloxane has the formula:

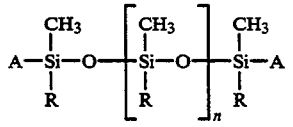

wherein R is an alkyl, alkenyl or aryl, or an aryl group substituted with an amino, hydroxy, mercapto or alkyl or alkenyl group, the functional group A is an alkene or alkyne, an alkene or alkyne substituted with an alkyl or aryl, and n is a number of from about 2 to about 350.

4. A toner transfer component in accordance with claim 1 wherein said dehydrofluorinating agent is selected from the group consisting of primary, secondary and tertiary aliphatic and aromatic amines, where the aliphatic and aromatic groups contain from about 2 to about 1 5 carbon atoms, and aliphatic and aromatic diamines and triamines contain from about 2 to about 15 carbon atoms.

5. A toner transfer component in accordance with claim 4 wherein said amine dehydrofluorinating agent is selected from the group consisting of N-(2-aminoethyl-3-aminopropyl)-trimethoxy silane, 3-(N-styrylmethyl-2-aminoethylamino) propyltrimethoxy silane hydrochloride and (aminoethylamino methyl) phenethyltrimethoxy silane.

6. A toner transfer component in accordance with claim 1 wherein the polymerization initiator Is a peroxide.

7. A toner transfer component in accordance with claim 6 wherein the peroxide is selected from the group consisting of benzoyl peroxide and azoisobutyronitrile.

8. A method of imaging comprising forming a latent image in an electrographic imaging or printing apparatus containing a photoconductive imaging member, developing the image with a dry toner composition, transferring the image to the intermediate transfer component of claim 1, and transferring the developed image to a suitable substrate, followed by affixing the image thereto.

9. A method of imaging comprising forming a latent image in an electrographic imaging or printing apparatus containing a photoconductive imaging member, developing the image with a liquid toner composition, transferring the image to the intermediate transfer component of claim 1, and transferring the developed image to a suitable substrate, followed by affixing the image thereto.

10. A toner transfer component in accordance with claim 1 wherein the elastomer contains resistive fillers.

11. A toner transfer component in accordance with claim 10 wherein the resistive fillers are comprised of carbon black.

12. A toner transfer component in accordance with claim 1 wherein there is selected as said substrate nickel.

13. A toner transfer component in accordance with claim 12 wherein said is a metal, a metal oxide, a thermoplastic or a thermosetting organic film.

14. A toner transfer component in accordance with claim 13 wherein the substrate is polyimide, or steel.

15. A toner transfer component in accordance with claim 1 wherein there is selected an intermediate layer located between the overcoating elastomer and the supporting substrate.

16. A toner transfer component in accordance with claim 15 wherein the intermediate layer is an adhesive.

17. A toner transfer component in accordance with claim 16 wherein the adhesive is a bisphenol A epoxy resin.

18. A toner transfer component in accordance with claim 16 wherein the adhesive is an amino functional siloxane, or an unsaturated silane.

19. An intermediate toner transfer component comprised of a substrate and thereover a coating comprised of a volume grafted elastomer which is a substantially uniform integral interpenetrating network of a hybrid composition of a fluoroelastomer and a polyorganosiloxane.

20. An intermediate toner transfer component consisting essentially of a substrate and thereover a coating comprised of a volume grafted elastomer which is a substantially uniform integral interpenetrating network of a hybrid composition of a fluoroelastomer and a polyorganosiloxane, and wherein said polyorganosiloxane is of the formula

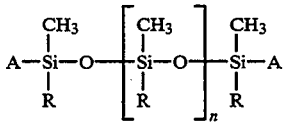

wherein R is an alkyl, alkenyl or aryl, or an aryl group substituted with an amino, hydroxy, mercapto or alkyl or alkenyl group, the functional group A is an alkene or alkyne, an alkene or alkyne substituted with an alkyl or aryl, and n is a number of from about 2 to about 350.

21. A method of imaging comprising forming a latent image in an electrographic imaging or printing apparatus containing a photoconductive imaging member, developing the image with a liquid toner composition, transferring the image to the intermediate transfer component of claim 22, and transferring the developed image to a suitable substrate, followed by affixing the image thereto.

* * * * *